US006389950B1

(12) United States Patent
Kühn et al.

(10) Patent No.: US 6,389,950 B1
(45) Date of Patent: May 21, 2002

(54) MANUALLY CONTROLLED LIFTING DEVICE WITH A PNEUMATIC LIFT DRIVE MECHANISM

(75) Inventors: Robert Kühn; Wolfgang Bittenbinder, both of Reimlingen (DE)

(73) Assignee: Mannesmann AG, Schweinfurt (DE)

( * ) Notice: Subject to any disclaimer, the term of this patent is extended or adjusted under 35 U.S.C. 154(b) by 0 days.

(21) Appl. No.: 09/640,247

(22) Filed: Aug. 16, 2000

Related U.S. Application Data

(63) Continuation of application No. PCT/DE99/00472, filed on Feb. 16, 1999.

(30) Foreign Application Priority Data

Feb. 16, 1998 (DE) ..... 298 02 606 U

(51) Int. Cl.[7] ..... B66F 19/00
(52) U.S. Cl. ..... 91/31; 91/443; 254/360
(58) Field of Search ..... 91/443, 31, 471, 91/444, DIG. 2; 254/386, 4 R, 360

(56) References Cited

FOREIGN PATENT DOCUMENTS

JP 09175800 A * 7/1997

* cited by examiner

*Primary Examiner*—F. Daniel Lopez
*Assistant Examiner*—Thomas S. Lazo
(74) *Attorney, Agent, or Firm*—Cohen, Pontani, Lieberman & Pavane

(57) ABSTRACT

A manually controlled lifting device is provided including a pneumatic lifting drive, a lifting member, a load carrying means, a pressure source, a pressure line, a flow control device, a pneumatic pressure switch and a vent drive. The lifting member is arranged on the pneumatic lifting drive and is a load transmitting component of at least two parts. The load carrying means is attached to the lifting member for carrying a load. The pressure line has a first end and a second end where the first end is in communication with the pressure source and the second end is in communication with the pneumatic lifting drive. The flow control device is in communication with the pressure line and integrated between the two parts of the load transfer component and the pressure source. The flow control device automatically varies a cross section of flow in the pressure line in relation to a load acting on the load carrying means. During a lifting operation a relatively larger cross section of flow is set during a high load and a relatively smaller cross section of flow is set during a lower load, while during a lowering operation a relatively smaller cross section of flow is set during a high load and a relatively larger cross section of flow is set during a lower load.

6 Claims, 3 Drawing Sheets

MANUALLY CONTROLLED LIFTING DEVICE WITH A PNEUMATIC LIFT DRIVE MECHANISM

This is an application claiming priority under 35 U.S.C. §111 and 37 C.F.R. §1.53 and is a continuation of International PCT application No. PCT/DE99/00472 which was filed on Feb. 16, 1999, published as publication No. WO 99/41185 on Aug. 19, 1999, and claims priority from German application No. 298 02 606.6 which was filed on Feb. 16, 1998.

BACKGROUND OF THE INVENTION

1. Field of the Invention

The present invention relates to a manually controlled lifting device having a pneumatic lifting drive, a lifting member connected to the drive and a load-carrying means arranged at the end of the lifting member. A pneumatic switch is integrated in a pressure line connecting a compressed-air source to a pressure space of the lifting drive. The pneumatic switch connects the pressure space of the lifting drive to the compressed-air source in one position and to a vent device in another position.

2. Description of the Related Art

A number of manually controlled lifting devices have been disclosed, in which the lifting member in the simplest case is formed by a rope. In other cases, the lifting member is formed, for example, by the jib of a manipulator, a scissors system of a lifting platform or the like. All of these designs exhibit the adverse phenomenon that the lifting and lowering speed greatly depends on the load to be moved. The reason for this lies in the basic relationship $p \cdot V=$ const. i.e. for a given lift, twice the air quantity at double the load has to be supplied to the pressure space of the lifting drive, a factor which results in a correspondingly reduced lifting speed. This may lead to unpleasant and even dangerous operating states, for example, when the lifting member is raised in an unloaded manner. In particular, if the lifting member is designed as a virtually massless rope, this leads to the rope shooting up abruptly, which causes the feared rope whip, which is exceptionally dangerous for the operator. A similar phenomenon occurs during the lowering of the load, if, during venting of the pressure space of the lifting drive, the load is lowered at high speed and strikes a base.

The object of the present invention, is to provide a lifting device with little extra technical outlay, which achieves at least approximately the same lifting and lowering speeds within the entire working range and irrespective of the load to be moved.

According to the present invention, this object is achieved in that a flow-control device lying in the load flow is integrated between two load-transmitting components. The flow control device is simultaneously connected in a compressed-air line between the pneumatic switch and the pressure space of the lifting drive. Under the action of the load, the flow control device acting on the load-carrying means, automatically varies the cross section of flow of the compressed-air line in such a way that:

a) during a lifting operation, a larger cross section of flow is set during high load than during low load, and b) during a lowering operation, a smaller cross section of flow is set during high load than during low load.

By these measures, a virtually identical lifting and lowering speed is always achieved irrespective of the load to be moved.

In order to realize this measure in terms of design, the flow-control device a) may contain two adjustable restriction valves which are connected in parallel with one another and with which:

b) a respective check valve is connected in series, and with c) a restriction valve which increases the restriction cross section during increasing load being assigned to the check valve which opens in the direction of flow from the pneumatic switch to the pressure space, and d) a restriction valve which reduces the restriction cross section during increasing load being assigned to the check valve which opens in the opposite direction of flow.

This combination of two adjustable restriction valves and two check valves ensures that dangerous rapid lifting and lowering operations described above are reliably avoided.

The restriction valves may be directionally controlled in such a way that, when their axial length changes, a corresponding change in the restriction effect occurs. Such restriction valves may be designed in such a way that a spring-loaded actuating pin projects from an axially extending housing, during the axial displacement of which actuating pin the restriction cross section in the housing interior is changed.

In order to achieve as compact a design as possible, it may be expedient to combine the two restriction valves, or alternatively both restriction valves and both check valves, to form a common construction unit.

The two restriction valves may be accommodated in a common outer housing in such a way that they bear with their two axial ends against the inner surfaces of two walls, opposite one another, of the outer housing. The mutual distance apart of which is variable under elastic deformation, on the outer surfaces of which walls tension or compression forces from load-transmitting components act.

The load-dependent elastic deformation of the outer housing thus acts on the restriction valves in such a way that a virtually identical lifting and lowering speed is set in all operating states.

SUMMARY OF THE INVENTION

The object of the present invention, is to provide a lifting device with little extra technical outlay, which achieves at least approximately the same lifting and lowering speeds within the entire working range and irrespective of the load to be moved.

According to the present invention, this object is achieved in that a flow-control device lying in the load flow is integrated between two load-transmitting components. The flow-control device is simultaneously connected in a compressed-air line between the pneumatic switch and the pressure space of the lifting drive. Under the action of the load, the flow control device acting on the load carrying means, automatically varies the cross section of flow of the compressed-air line in such a way that:

a) during a lifting operation, a larger cross section of flow is set during high load than during low load, and b) during a lowering operation, a smaller cross section of flow is set during high load than during low load.

By these measures, a virtually identical lifting and lowering speed is always achieved irrespective of the load to be moved.

In order to realize this measure in terms of design, the flow-control device:

a) may contain two adjustable restriction valves which are connected in parallel with one another and with which b) a respective check valve is connected in series, and with c) a restriction valve which increases the restriction cross section during increasing load being assigned to the check valve which opens in the direction of flow from the pneumatic switch to the pressure space, and d) a restriction valve which reduces the restriction cross section during increasing load being assigned to the check valve which opens in the opposite direction of flow.

This combination of two adjustable restriction valves and two check valves ensures that dangerous rapid lifting and lowering operations described above are reliably avoided.

The restriction valves may be directionally controlled in such a way that, when their axial length changes, a corresponding change in the restriction effect occurs. Such restriction valves may be designed in such a way that a spring-loaded actuating pin projects from an axially extending housing, during the axial displacement of which actuating pin the restriction cross section in the housing interior is changed.

In order to achieve as compact a design as possible, it may be expedient to combine the two restriction valves, or alternatively both restriction valves and both check valves, to form a common construction unit.

The two restriction valves may be accommodated in a common outer housing in such a way that they bear with their two axial ends against the inner surfaces of two walls, opposite one another, of the outer housing. The mutual distance of the walls is variable under elastic deformation, on the outer surfaces of which walls tension or compression forces from load-transmitting components act.

The load dependent elastic deformation of the outer housing thus acts on the restriction valves in such a way that a virtually identical lifting and lowering speed is set in all operating states.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

Embodiments of the present invention are shown in the drawings in schematic form as follows.

DETAILED DESCRIPTION OF THE PRESENTLY PREFERRED EMBODIMENTS

Figure 1:
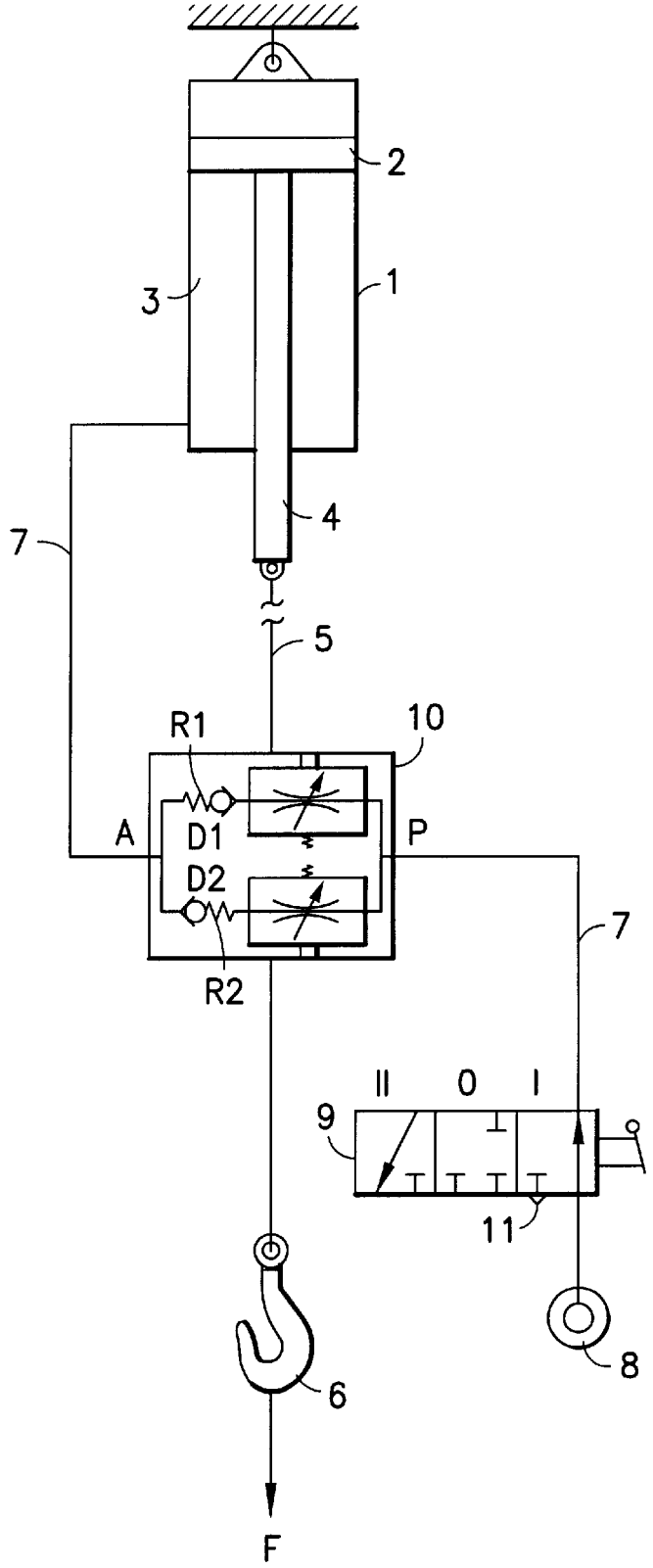
FIG. 1 is a lifting device with a rope as lifting member in partial longitudinal section.

Referring now to FIG. 1, a lifting device of the present invention is shown. A pneumatic lifting drive 1 is shown in the form of a pneumatic cylinder, in which a pressure space 3 is arranged below a piston 2. A rope or cable 5 is fastened as a lifting member to the piston rod 4. At the bottom end of the cable 5 is a crane hook 6 as load carrying means.

The pressure space 3 is fed with compressed air from a compressed-air source 8 via a pressure line 7. A pneumatic switch 9 is connected in the pressure line 7 downstream of the compressed-air source 8 and a flow-control device 10 is connected in the pressure line 7 in further sequence downstream of the pneumatic switch 9.

The pneumatic switch 9 has three switching positions I, 0 and II. In switching position I shown, the switch allows the compressed air to flow unimpeded from the compressed-air source 8 to the flow-control device. If the switch is put into switching position 0, flow is prevented, as is a backflow of air via the pressure line 7. In this switching position, a lifted load, for example, is held in the position reached. Finally, in switching position II, the compressed-air supply from the compressed-air source 8 is shut off, while backflow of the air from the pressure space 3 to the vent device 11 is opened.

When the compressed air continues to flow after leaving the switch 9, it reaches the flow-control device 10, where the compressed-air line is branched and passes to two adjustable restriction valves D1, D2 which are connected parallel to one another. Downstream of the adjustable restriction valves D1, D2 are respective check valves R1 and R2 connected in series. The compressed-air line is then united again and thus passes to the pressure space 3 of the lifting drive 1.

If, in the position shown of the pneumatic switch 9, the compressed air coming from the compressed-air source 8 flows to the flow-control device 10, it can flow to the pressure space 3 through the adjustable restriction valve D1 and the check valve R1, which then opens. The second flow path via the restriction valve D2 through the check valve R2 is shut off. The restriction valve D1 is adjusted to the force F acting on the crane hook 6 in such a way that the restriction cross section is reduced at a low load F but is increased during an increasing load F. This achieves the effect that the lifting speed is at least approximately uniform irrespective of the size of the load.

If the load acting on the crane hook 6 is to be lowered, the pneumatic switch 9 must be put into the switching position II. As a result, the pressure line 7 is connected to vent device 11. In the process, the air discharging from the pressure space 3 during the lowering of the piston 2 flows via the pressure line 7 to the flow-control device 10, where it now opens the check valve R2 and then flows through the adjustable restriction valve D2. In this case, the restriction valve is adjusted as a function of the force F acting on the crane hook 6 in such a way that it reduces the restriction cross section during increasing force F and thus prevents abrupt lowering of the load.

Figure 2:
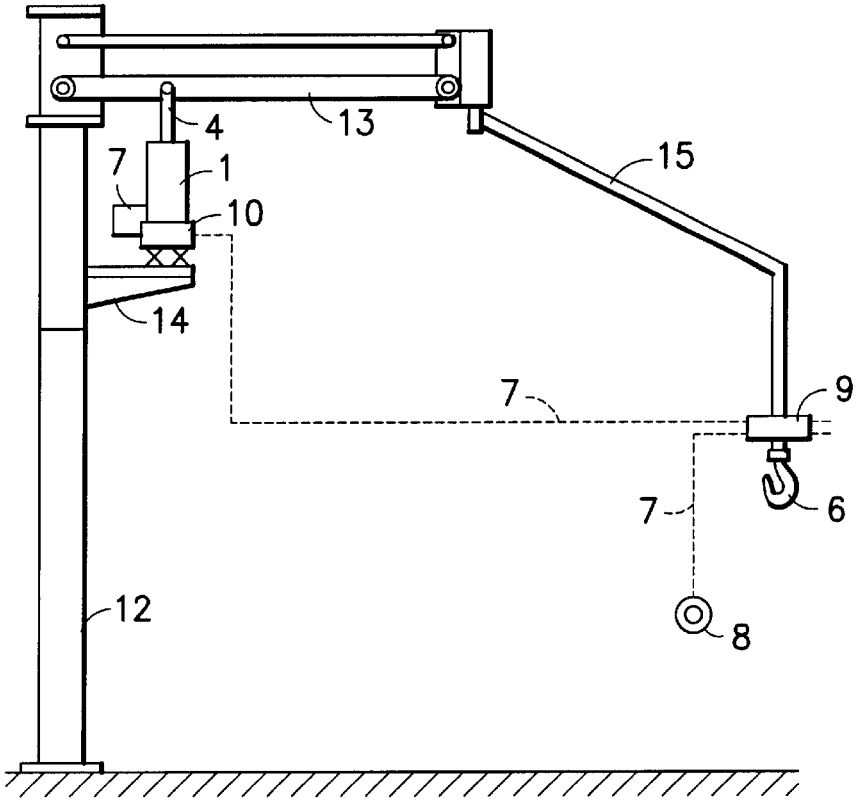
FIG. 2 is a side view of a lifting device with a mechanical jib as a lifting member.

In the embodiment of a lifting device shown in FIG. 2, a parallelogram jib 13 and a bracket 14 are mounted so as to be swivellable on an upright 12. A pneumatic lifting drive 1 is supported on the bracket 14 with a flow-control device 10 in between and acts by means of the piston rod 4 on the parallelogram jib 13. As a result of this action, the jib 13 can be lifted and lowered. A load arm 15, which carries a crane hook 6 at its end, is pivotably mounted on the parallelogram jib 13. Arranged above the crane hook 6 is a pneumatic switch 9, which is connected via a pressure line 7 on the one hand to a compressed-air source 8 and on the other hand to the flow-control device 10, which in turn is connected via a pressure line 7 to the pressure space of the lifting drive 1. Here, the action sequence is the same as described above for FIG. 1.

Figure 3:
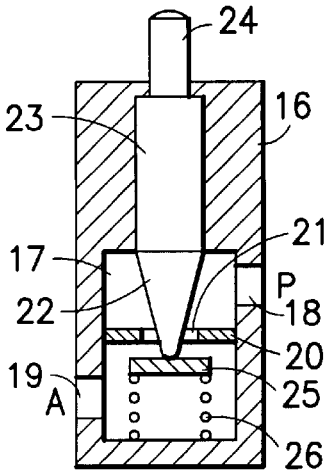
FIGS. 3 to 5 are longitudinal sections through different types of embodiment of restriction valves.

Shown in FIG. 3 is an adjustable restriction valve which consists of a housing 16, the interior space 17 of which has a supply-air port 18 and an exhaust-air port 19. Arranged between these ports in the interior space 17 is an intermediate wall 20, which has a restriction bore 21. Plunging into the latter is a conical restriction needle 22, which is connected to a cylindrical guide part 23. The guide part 23 is mounted in the housing 16 in a longitudinally displaceable manner and in turn has an actuating pin 24 projecting axially from the housing 16. Bearing against the restriction needle from below is a pressure plate 25, which is under the action of a spring 26, which presses the restriction needle into a top end position. If this restriction valve is installed in a flow-control device in such a way that the actuating pin 24 is pressed into the housing 16 during increasing load, the restriction cross section is increasingly reduced as a result.

Figure 4:
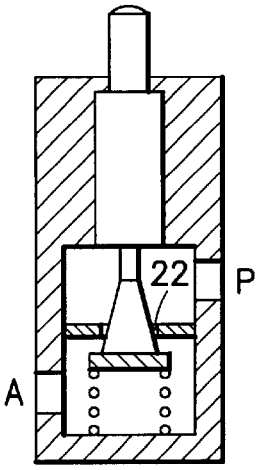

The embodiment of a restriction valve shown in FIG. 4 differs from that according to FIG. 3 merely in that the restriction needle 22 is designed to be conical in the opposite direction, so that in this case the restriction cross section is increased when the actuating pin 24 is pressed into the housing 16.

Figure 5:
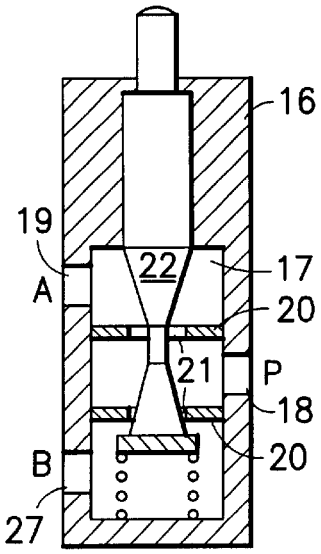

Finally, FIG. 5 shows an embodiment of a double-acting restriction valve. In this restriction valve, a supply-air bore 18 opens into the interior space 17 of the housing 16. Two exhaust-air ports 19 and 27 are provided at an axial distance from one another. Provided in the interior space 17 between the supply-air port 18 and each of the exhaust-air ports 19 and 27 is a respective intermediate wall 20, which in each case has a restriction bore 21. A conical restriction needle 22 plunges into each of these restriction bores, the restriction needles 22 being connected to one another and being designed to be conical in opposite directions. If the actuating pin is pressed downward in this case, the restriction cross section between the supply-air port 18 and the exhaust-air port 19 is at the same time increasingly reduced, while the restriction cross section between the supply-air bore 18 and the exhaust-air bore 27 is at the same time increased. Thus this restriction valve replaces the two restriction valves D1 and D2 shown in FIG. 1.

Figure 6:
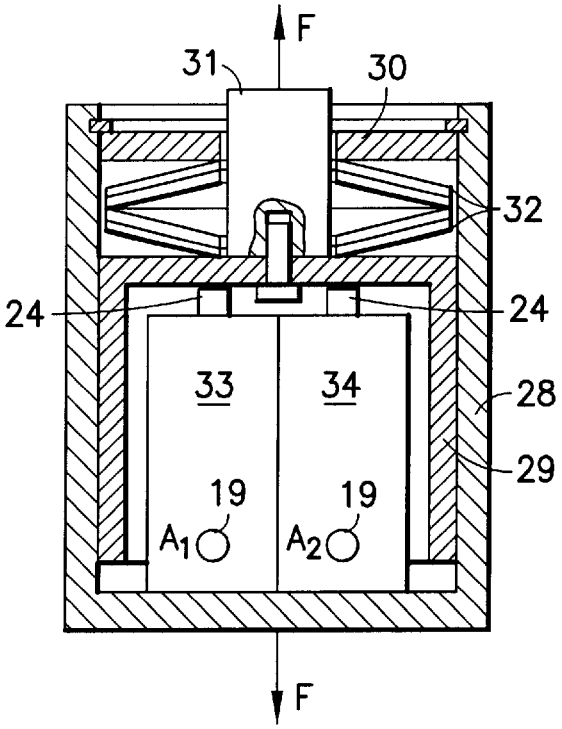
FIGS. 6 to 8 are different embodiments of outer housings for accommodating restriction valves.

Shown in FIG. 6 is a pot-shaped outer housing 28 in which a hollow piston 29 which is pot-shaped in the opposite direction is mounted in a longitudinally displaceable manner. The outer housing 28 is closed at its open end by an inserted lid 30, through which a tension pin 31 projects, which is connected to the base of the hollow piston 29 by means of a screw. Arranged between the base of the hollow piston 29 on the one hand and the lid 30 on the other hand is a disk-spring stack 32, which presses the hollow piston 29 downward in the outer housing 28. Two adjustable restriction valves 33 and 34 are inserted in the cavity enclosed by the outer housing 28 and the hollow piston 29. The restriction valves 33 and 34 are supported on the closed base of the outer housing on the one hand and with their actuating pins 24 on the closed base of the hollow piston on the other hand. One of the restriction valves 33 and 34 is a restriction valve in accordance with FIG. 3 and the other is a restriction valve in accordance with FIG. 4. If this component is fitted in the cable 5 in accordance with FIG. 1 for example, the cable forces act on the tension pin 31 on the one hand and on the base of the outer housing 28 on the other hand. As a result, the hollow piston 29 is displaced upward against the action of the spring stack 32 with increasing load, as a result of which the actuating pins 24 come further out of the housings of the restriction valves 33 and 34 and thus the restriction cross sections are changed in the interior.

Figure 7:
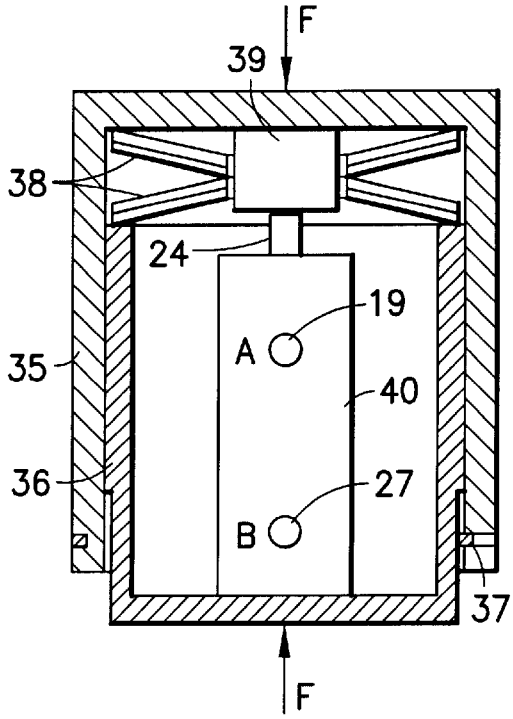

An inverted embodiment is shown in FIG. 7. In this case too, there is an outer housing 35, in which a hollow piston 36 is mounted in a longitudinally displaceable manner and is secured against coming out at the bottom by a snap ring 37. Acting between the base of the outer housing 35 and the end face of the hollow piston 36 is a disk-spring stack 38, in the center of which a supporting part 39 is provided, which supports the actuating pin 24 of a double-acting restriction valve 40 in accordance with FIG. 5. In this case, this component, which is subjected to compress ion by the load to be moved by the lifting device, may be used, for example, in an embodiment according to FIG. 2.

Figure 8:
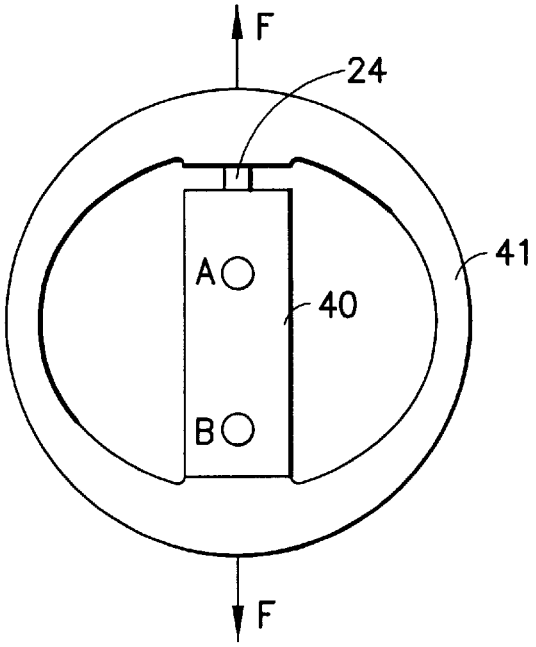

Finally, FIG. 8 shows a relatively simple embodiment in which a double-acting restriction valve 40 i5 inserted into a metal ring 41, which, at points which lie in the longitudinal direction of the restriction valve, is deformed during the action of tension and compression forces in such a way that the actuating pin 24 is pressed into the restriction valve 40 in one case or can come further out of the restriction valve 40 in the other case.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A lifting device, comprising:

a pneumatic lifting drive defining a pressure space in an interior of the lifting drive;

a lifting member connected to the pneumatic lifting drive and being a load transmitting component, the load transmitting component comprising at least two parts;

load carrying means attached to the lifting member for carrying a load;

a pressure source;

a pressure line comprising a first end and a second end, the first end being in communication with the pressure source, the second end being in communication with the pressure space of the pneumatic lifting drive;

a flow control device arranged between the two parts of the load transmitting component and in communication with the pressure line and the pressure source, the flow control device being operative to automatically vary a cross section of a flow of the pressure line in relation to a load acting on the load carrying means, whereby during a lifting operation a relatively larger cross section of the flow is set during a high load and a relatively smaller cross section of the flow is set during a lower load, while during a lowering operation the relatively smaller cross section of the flow is set during the high load and the relatively larger cross section of the flow is set during the lower load;

a pneumatic switch in communication with the pressure line and arranged between the flow control device and the pressure source, the pneumatic switch connecting the pressure source to the pressure space of the lifting drive, and a vent device arranged on the pressure line, wherein the pneumatic switch connects the pressure space of the lifting drive to the pressure source in a first position and connects the pressure space of the lifting drive to the vent device in a second position.

2. The lifting device according to claim 1, wherein the flow control device comprises:

a first adjustable restriction valve and a second adjustable restriction valve being connected in parallel to one another, wherein the first restriction valve increases a restriction cross section during increasing load and the second restriction valve reduces the restriction cross section during increasing load; and a first check valve and a second check valve, the first check valve being connected in series with the first adjustable restriction valve and the second check valve being connected in series with the second check valve, so that the first check valve opens in a first direction of flow from the pneumatic switch to the pressure space and the second check valve opens in a second direction of flow opposite to the first direction of flow.

3. The lifting device according to claim 2, wherein the restriction valves are operative to respond to an applied force with a change in an axial length of the restriction valves which causes a change in flow in the pressure line.

4. The lifting device according to claim 2, wherein the restriction valves are constructed as a single unit.

5. The lifting device according to claim 2, wherein the restriction valves and the check valves are constructed as a single unit.

6. The lifting device according to claim 2, further comprising:

an outer housing having opposing axial walls for accommodating the first and second restriction valves, the walls being elastically deformable, wherein upon application of an applied force from the load transmitting component, the first and second restriction valves bear against an inner side of the opposing axial walls causing a distance of the opposing axial walls to vary in relation to the applied force.

* * * * *

UNITED STATES PATENT AND TRADEMARK OFFICE

CERTIFICATE OF CORRECTION

PATENT NO. : 6,389,950 B1
DATED : May 21, 2002
INVENTOR(S) : Robert Kühn

It is certified that error appears in the above-identified patent and that said Letters Patent is hereby corrected as shown below:

Title page,
Item [73], should read: -- Mannesmann AG
Mannesmannufer 2
Düsseldorf
Germany
D-40213 --

Signed and Sealed this

Eleventh Day of February, 2003

JAMES E. ROGAN
*Director of the United States Patent and Trademark Office*